United States Patent [19]

Caggiano

[11] Patent Number: 4,592,899

[45] Date of Patent: Jun. 3, 1986

[54] SMOKE FILTER WITH FRANGIBLE SUPPORTED FILTER BED

[75] Inventor: Michael A. Caggiano, Chelsea, N.Y.

[73] Assignee: Texaco Inc., White Plains, N.Y.

[21] Appl. No.: 686,552

[22] Filed: Dec. 26, 1984

[51] Int. Cl.[4] ..... F01N 3/10

[52] U.S. Cl. ..... 422/180; 60/302

[58] Field of Search ..... 422/176, 179, 180, 177, 422/182, 183; 60/299, 302; 431/268; 29/15 TR

[56] References Cited

U.S. PATENT DOCUMENTS

| | | | |
|---|---|---|---|
| 3,154,388 | 10/1964 | Purse | 422/179 |
| 3,189,418 | 6/1965 | Gary | 422/180 X |
| 3,597,165 | 8/1971 | Keith et al. | 422/180 |
| 3,768,982 | 10/1973 | Kitzner et al. | 422/180 X |
| 3,926,565 | 12/1975 | Birtigh et al. | 422/180 X |
| 3,984,207 | 10/1976 | Abthoff et al. | 422/180 X |
| 4,247,520 | 1/1981 | Worner | 422/180 X |
| 4,360,957 | 11/1982 | Eng | 422/180 X |

*Primary Examiner*—Richard L. Chiesa

*Attorney, Agent, or Firm*—Robert A. Kulason; James J. O'Loughlin; Robert B. Burns

[57] ABSTRACT

Filter for removing combustible particulate matter from a diesel exhaust gas stream, prior to said stream being discharged into the atmosphere. The filter includes a reinforced bed formed of a frangible filter media comprised of a mass of randomly disposed fibers. The fibrous mass is provided with a bed support member that affords the fibrous mass added physical strength, but also serves to direct hotter exhaust gases toward the peripheral cover parts of the filter casing.

8 Claims, 4 Drawing Figures

SMOKE FILTER WITH FRANGIBLE SUPPORTED FILTER BED

BACKGROUND OF THE INVENTION

With any internal combustion engine it is desirable that exhaust gases be treated so that they can be safely discharged into the atmosphere. In some engines, particularly of the diesel type, among the most prevalent operating problems is the presence of particulates of varying size, which are carried in the exhaust gas stream.

The particulates are normally bits of carbon. They result from the incomplete combustion of hydrocarbon fuels under certain engine operating conditions. However, the operating efficiency of the engine is also a contributing factor to the amount of carbon produced.

The presence of relatively large amounts of carbon particles in any exhaust gas stream is evidenced by a dark, smoky, undesirable effluent. Such smoke is not only offensive aesthetically; in large quantities it can be unhealthy. The problem is most evident in the operation of diesel engines.

Means have been provided and are known to the prior art, for the elimination or minimization of the particulate content in exhaust discharge streams. It has been found, that while the particulates can be eliminated by a suitable smoke filter of proper construction, eventually however the filter bed can become saturated and/or inoperable. The latter results from excessive particulate accumulations in certain parts at the filter which, over a period of operation, will block flow passages.

It is further known that the overall engine exhaust gas treating process can be expedited to a degree. This is achieved primarily by passing the hot gas stream through a filter medium. The process can be expedited by providing the filter with a catalyst which is capable of promoting combustion of retained particles.

It should be appreciated that the generation of carbon particles is prevalent under virtually all diesel engine operating conditions. It is further appreciated that the quality of an exhaust gas stream produced by any internal combustion engine will vary in accordance with the immediate operating characteristics of the engine.

For example, the temperature range experienced by a diesel exhaust gas stream can vary between slightly above ambient, to temperatures in excess of 1200° F. When the exhaust gas is hot enough, the carbon particles trapped in a filter will, upon contact with the hot gas, be combusted. However, in diesel powered passenger cars, engine operating conditions under which this automatic rejuvenation can occur, is seldom realized.

Where it is determined that an engine continuously operates under circumstances that the particulates are continuously produced and accumulated in the filter, the particulate retaining bed must be periodically rejuvenated.

Under some circumstances, and as noted above, rejuvenation will consist of merely introducing the hot exhaust gas stream, containing sufficient oxygen, into the filter bed to contact and ignite the retained carbon particles. The combustion of any large and confined carbon accumulation tends to produce temperatures greatly in excess of that of the exhaust gas. The result is that at such excessively high temperatures, parts of a frangible filter bed or even the filter's metallic outer casing, are susceptible to thermal shock, damage or distortion.

Stated otherwise, the filter bed, when formed of metallic fibers or a similar frangible filter media, is constructed in a manner to be characterized by a sufficient fiber density to remove solid particulate matter. The filter mass, however, should not be so dense as to establish too great a back pressure against the flow of exhaust gas.

To withstand the high temperatures which can be expected in internal combustion engine operation, the filter media here contemplated is preferably formed of metallic fibers such as stainless steel wool or the like. Such fibers are capable of being readily bent or deformed. Thus, a mass of randomly disposed fibers can be compressed to a desired density, received within a reaction chamber, and perform the desired particulate removing function. The degree to which it is compressed will determine the size of the gas flow passages therethrough.

When a filter bed of metallic fibers is utilized in an exhaust gas treatment system, the hot gas stream will tend to follow the path of least resistance from the casing inlet to the outlet. As a general rule, for a uniform density filter bed, this path will be through the center of the bed, or along a path determined by the relative positioning of the inlet and outlet.

As a consequence, the bed outer or peripheral edges will receive a minimal amount of retained particulate matter. As a further consequence, the particulate accumulations will be concentrated in those areas or those parts of the bed where gas flow is most concentrated.

During the rejuvenation period when combustible accumulations are burned off, the thermal intensity of incineration will be concentrated at certain parts of the bed. Thus, while the rejuvenation process is found to be successful, it might have been achieved at the expense of the parts of the bed which have been permanently deformed or otherwise thermally damaged due to prolonged exposure to the excessive heat.

This thermal damage is most noticeable at the downstream end of the flow path. Generally, the filter bed will develop a conically shaped, discolored, defective area adjacent to the filter casing outlet. It results from the combined effect of the incineration combustion, together with the hot exhaust gas as the latter becomes progressively heated while transversing the filter bed.

Toward overcoming the stated problems endemic to exhaust gas filters, there is presently provided a filter having a reinforced bed formed of randomly disposed and compressed metallic fibers. The latter are sufficiently compacted to define a plurality of passages through which the hot exhaust gas will flow.

To assure stability of the bed under the arduous temperature and operating conditions, the bed is provided with an internal structural support member. The latter comprises a central core piece which extends longitudinally of the bed. A plurality of heat conductors and rigidifying arms depend outwardly from the core piece and into the bed. A flow diverter at one end of the core piece functions to divert hot gas outwardly into the cooler, peripheral regions of the bed.

The physical composition, and the packed density of the mass of the overall bed is relatively uniform. Thus, the exhaust gas flow pattern through the respective bed passages, in following a path of minimal resistance will extend generally between the casing inlet and outlet but will contact the conical diverter and be deflected.

It is therefore an object of the invention to provide an effective exhaust gas filter for removing particulate combustible matter from an exhaust gas stream.

A further object is to provide an exhaust gas filter which can be safely operated and rejuvenated at high temperatures without jeopardizing the integrity of the filter medium.

Another objective is to provide a filter which utilizes a frangible through compressible filter media which is compressed to a desired density about an internal, heat conductive support member.

DESCRIPTION OF THE DRAWINGS

Referring to FIG. 1, to facilitate description of the instant filter and its system, an internal combustion engine 10 or other source of exhaust gas will be considered to be of the diesel type. In the latter, air is sequentially introduced from an air filter 11, by way of a manifold 12 to the engine's various combustion chambers.

Figure 1:
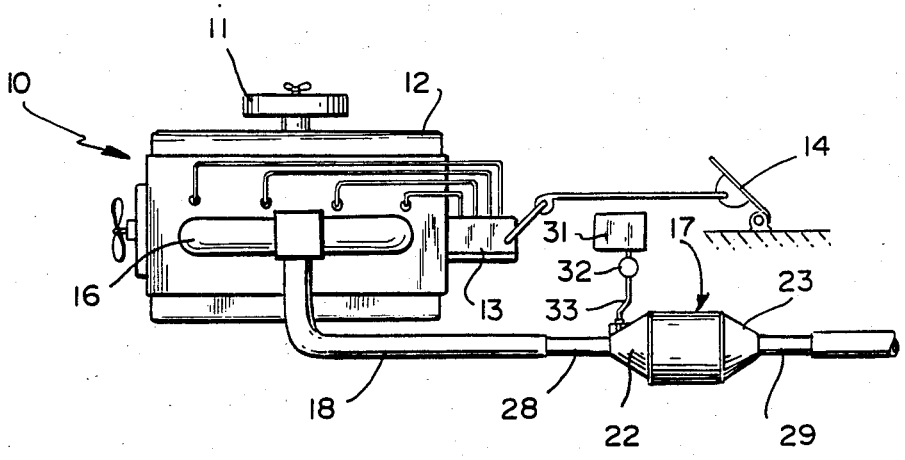
FIG. 1 is an elevation view of an internal combustion engine embodying the present exhaust gas filter.

Diesel fuel is thereafter injected in controlled amounts into each combustion chamber from a fuel pump 13. Fuel flow is regulated by control linkage 14 which can be depressed by an operator's foot.

The hot exhaust gas stream is led from exhaust manifold 16 and conducted through an exhaust pipe 18 to a smoke filter 17. Although a sound absorbing muffler could be inserted into the exhaust pipe, such an element is ancillary to the instant system and its method of operation with respect to filtering the exhaust gas.

The hot exhaust gas stream subsequent to leaving exhaust manifold 16 will usually be at a temperature within the range of about 200° to 1200° F. The precise temperature will depend, as herein noted, on the particular operating conditions and the efficiency of the engine.

For example, at low and idle speeds, exhaust gas will be relatively cool or only moderately heated. Consequently, and referring to FIG. 2, as the particle laden exhaust gas stream enters filter 17, the particulates will be retained along the many diverse passages within the supported or reinforced filter bed 19.

The hot exhaust gas is comprised primarily of a combination of gases. Normally, however, it embodies sufficient oxygen content to support at least a limited degree of combustion within the stream itself.

Referring again to FIG. 2, in one embodiment, filter 17 comprises an elongated metal casing 21 having opposed end walls 22 and 23 which define an internal reaction chamber 24. The latter chamber is occupied to a large extent by reinforced filter bed 19, formed as will be hereinafter noted, particularly to provide a plurality of flow passages therethrough.

The primary function of bed 19 is to define a series of irregular passages along which hot exhaust gas will flow. During the initial or deposition cycle, particulate matter carried on the exhaust gas stream will be retained on the various passage walls of bed 19. Over a period of time a second cycle will commence to in effect cause incineration of the retained combustible particles. The latter, as noted herein are normally carbon which will combust to gaseous form and be discharged through the filter downstream end.

Bed 19 is preferably supported at its respective upstream and downstream ends by perforate panels 26 and 27 or similar members. These panels can take the form of screens or other similar rigid, gas permeable transverse members. The panels are positioned or removably held in casing wall 21, or they can detachably engage the elongated bed support element 25. The panels are particularly desirable in countering the effects of a hot, rapidly flowing gas stream against the filter bed, which tends to displace and compress the bed toward its downstream end.

The filter upstream end wall 22 is provided with an inlet port 28 for introducing exhaust gas to the upstream side of bed 19. In a similar manner, conical wall 23 is communicated with a discharge conduit 29 to carry away particulate-free gases which leave reinforced bed 19.

In the operation of a normal filter of the type generally contemplated, flowing of the particle laden exhaust gas through filter bed 19 will, as mentioned, cause an accumulation of the combustible material in and about the bed passages. Over a period of time the continued build-up will cause at least some of the more heavily used passages to become blocked to the point where the filter could become inoperable or highly inefficient.

As a matter of practicality it becomes necessary to open these passages, or to rejuvenate the filter by disposing of the combustible particulate matter. It is found that the latter can be achieved through a process of carefully controlled incineration so that the combustible matter passes from the filter in the form of a safe, hydrocarbon gaseous discharge.

Among the known ways of instituting incineration of the combustible accumulations, the prior art has taught that the most simple is to increase the temperature of the exhaust gas prior to or immediately upon its reaching the filter. This increase is achieved in any of several methods. One such method includes the addition to the exhaust gas stream of a metered amount of a secondary combustible fuel. The latter can take the form of a liquid or even a vapor, and is preferably the fuel being utilized in the engine such as diesel fuel.

In any instance, the combustible secondary fuel is introduced to the exhaust gas stream in a manner to ignite upon contact with the stream. Alternately, upon contact of the resulting fuel mixture with a catalyst at the upstream end of the filter bed. Thus, as the heated exhaust stream contacts the carbon accumulations the latter will be ignited.

To facilitate a filter rejuvenation cycle the instant exhaust gas system includes a source of a secondary fuel 31. Metering means 32 communicated with source 31, is provided to periodically inject a measured amount of said fuel through line 33 to an injector 34 which opens into casing wall 22.

Operationally, secondary fuel can be injected into the hot exhaust gas stream at pre-set intervals, or in response to a condition in the filter which suggests carbon accumulation.

The prior art also teaches means for instituting combustion of collected carbon particles through the facility of temporarily enriching the fuel mixture flowing to the engine. The exhaust gases will thus be produced at a higher temperature without the need for a supplementary fuel injection.

Figure 3:
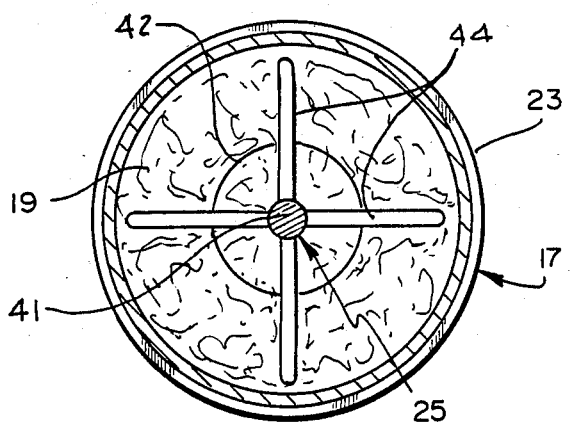
FIG. 3 is a cross-sectional view taken along line 3—3 of FIG. 2.

As shown in FIG. 3, one effect of igniting accumulated carbon particles, no matter how initiated, could result in the aforementioned problem of damage to the filter media or bed. Even though the incineration process might be controlled, the problem of filter bed thermal damage has not been completely eliminated.

Figure 4:
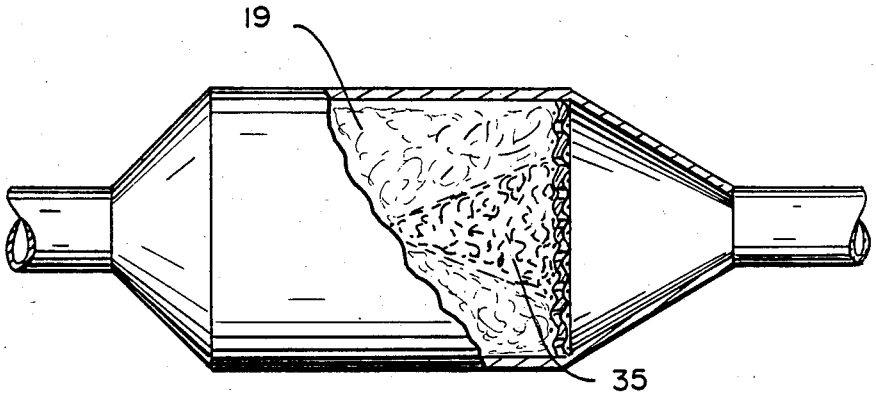
FIG. 4 (PRIOR ART)
FIG. 4 illustrates a filter of the type adapted to treat a hot exhaust gas.

The problem is particularly true at the filter discharge side and more particularly in the area 35, as shown in FIG. 4, adjacent to the discharge opening which in effect terminates the hot gaseous flow through filter bed 19. In examining filters which have been thermally damaged due to uncontrolled burning of the carbon accumulations, the bed has usually exhibited a conical area which progressively narrows from the rear of the bed toward the forward end.

The basic filter media contemplated by applicants for use herein is disclosed in a number of patents including U.S. Pat. No. 4,360,957, King D. Eng. Said media is comprised generally of metallic wires, fibers, or fibrils, which are randomly disposed to form a fibrous mass much in the manner of steel wool. The metallic wires are preferably steel or stainless steel, which wires form a substrate for a subsequently applied surface coating of alumina, and/or a catalyst.

To promote the filtering or rejuvenating action within the filter bed, the alumina can be further provided with a coating of a catalytic material whereby to prompt combustion of a supplementary fuel mixture with the exhaust gas. The primary function of the filter media is to retain along the passage walls, those solid particles which are carried through the tortuous passages of the filter bed as the gas progresses to the filter downstream end thereof.

The metallic wool-like wires are normally compressed into a fibrous mass to afford the mass a desired density. It is appreciated that as a practical matter, the more the fibers are compressed, the greater will be the density of the filter bed. This factor will, however, increase back pressure against gas flow; it must therefore be moderated.

Frequently a filter casing of the type contemplated is formed in a cylindrical or oval shape to best be utilized for a particular application. For example, when the filter is to be used on a passenger vehicle, it will normally be placed at the underside of the vehicle. Further, it will be shaped to minimize its closeness to the ground. Thus, the filter casing will be conformed preferably into a general oval shape with the gas inlet and outlet positioned at opposed ends of the casing.

If practical, the inlet and outlet openings will be in substantial alignment relative to the filter casing. However the configuration of the particular automobile body and frame might be such as to warrant positioning of the inlet and outlet in a manner that they are unaligned. They will therefore be arranged to best accommodate other connectors and conduits in the exhaust system.

Figure 2:
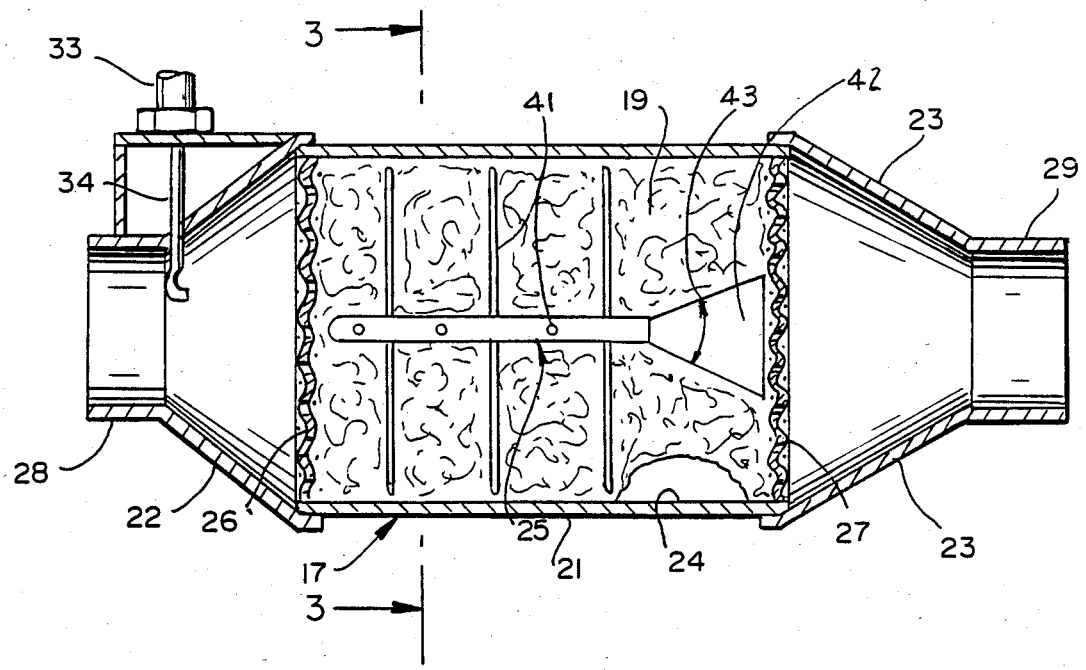
FIG. 2 is a cross-sectional view on an enlarged scale of the exhaust gas filter.

Referring to FIGS. 2 and 3, in a preferred embodiment of the instant reinforced filter bed 19, the latter includes as herein noted, primarily an elongated supporting element 25 that is positioned substantially longitudinally of the filter casing. Said supporting element is embedded in or enclosed by the fibrous mass. Element 25 is comprised of a central spine or core piece 41 which extends at least partially through the bed center.

The core piece 41 can be formed in hollow, tubular construction but is preferably a solid rod. The rear end of core 41 carries a conical piece 42 which includes a divergent surface extending outward from rod 41 toward the bed 19 rear face. The core piece as noted is preferably a hollow member, but is formed of a thermally resistent metal such as steel which is capable of withstanding the elevated temperatures and harsh conditions which result from the hot flowing exhaust gas as the latter moves toward the filter discharge port.

The conical member 42 is provided with divergent outer surface 43 having an incidental angle of between 25 and about 45 degrees. The angle of said divergent surface is sufficient to achieve two functions. Firstly, it deflects or diverts rearwardly flowing exhaust gas toward the filter bed 19 periphery. At the latter, the hot, flowing gas stream will be caused to mix with the relatively cooler gas along the bed edges.

Casing 21 will normally be maintained at a more moderate temperature than the interior of the filter bed 19 since the casing will radiate much of its heat to the surrounding atmosphere. In achieving its purpose, the divergent angle of the conical member 42 is such as to define an annular passage with the adjacent casing wall, through which the treated exhaust gas will flow on its passage toward the discharge conduits 29.

The central core or spine member 41 is further provided with a plurality of arms or bracing members 44 which depend from the core in a general radial direction. Arms 44 as shown terminate adjacent to the casing 21 inner wall and are in a sufficient number to both support the frangible filter mass, and also moderate the temperature at the center of the core by radiating heat outward toward the bed periphery.

Specifically, the radially extending arms 44 are disposed in intimate thermal contact with the fibrous mass of bed 19. The primary function of the array of radial arms 44 is to not only afford internal support to the frangible mass, but to distribute the heat generated by the exhaust gas both during the filtering and the rejuvenation cycles, toward the bed 19 periphery.

As shown in FIG. 3, the respective arms 44 are a desired length in accordance with the configuration of casing 21 whereby to terminate adjacent to the casing 21 inner wall. The arms are relatively thin to permit their functioning as a back-up or support element for the frangible bed and yet minimize interference with the flow of gas through the filter.

Although not specifically shown, the entire support element 25 can be adapted at opposed ends to slidably engage corresponding supports at the respective panels 26 and 27. Thus, as the support member is lengthened in response to elevated gas temperatures, a supporting relationship will be maintained.

It is further understood that although modifications and variations of the invention may be made without departing from the spirit and scope thereof, only such limitations should be imposed as are indicated in the appended claims.

I claim:

1. A filter for treating a stream of hot exhaust gas which carries an amount of combustible particulate matter from an internal combustion engine, and which filter includes means to incinerate the said particulate matter into gaseous state prior to discharge of the treated exhaust gas into the atmosphere at the filter downstream end, said filter further including an elongated casing which defines a reaction chamber having an inlet communicated with the source of said hot exhaust gas, and a casing outlet at said downstream end, an internally reinforced filter bed positioned in said reaction chamber defining particulate retaining passages through which said hot exhaust gas flows, said internally reinforced bed comprised of randomly disposed metallic fibers which are compacted into a resilient fibrous mass to form particulate retaining passages, and a support member extending longitudinally of the internally reinforced bed, and including an elongated core piece, and a plurality of thin thermally conductive arms positioned at locations along the longitudinal axis of the support member and depending outwardly from said core piece into said fibrous mass.

2. In a filter as defined in claim 1, wherein said thermally conductive arms extend radially from said core piece toward the casing wall.

3. In a filter as defined in claim 1, wherein said thermally conductive arms are arranged longitudinally along from the core piece and extend radially therefrom.

4. In a filter as defined in claim 1, wherein said support member includes an outwardly divergent conical element depending therefrom.

5. In a filter as defined in claim 4, wherein said outwardly divergent conical element includes a peripheral edge disposed adjacent to but spaced from said casing to define an annular passage therebetween.

6. In a filter as defined in claim 4, wherein said outwardly divergent conical element is positioned at the downstream end of said reinforced bed.

7. In a filter as defined in claim 1, including spaced apart perforate panels disposed transversely of the casing at the respective upstream and downstream ends of said randomly disposed metallic fibrous mass, and said support member being operably engaged with at least one of said spaced apart perforate panels.

8. In a filter as defined in claim 7, wherein said support member core piece is adapted on at least one end to slidably engage said at least one transverse panel whereby to allow movement therebetween when the core piece is longitudinally adjusted in response to temperature changes within the filter.

* * * * *